US010607768B2

(12) United States Patent
Tsukada et al.

(10) Patent No.: US 10,607,768 B2
(45) Date of Patent: Mar. 31, 2020

(54) AC REACTOR HAVING TERMINAL BASE

(71) Applicant: FANUC CORPORATION, Yamanashi (JP)

(72) Inventors: Kenichi Tsukada, Yamanashi (JP); Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 127 days.

(21) Appl. No.: 15/916,969

(22) Filed: Mar. 9, 2018

(65) Prior Publication Data

US 2018/0268991 A1 Sep. 20, 2018

(30) Foreign Application Priority Data

Mar. 17, 2017 (JP) ..... 2017-053291

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 37/00*** | (2006.01) |
| ***H01F 27/24*** | (2006.01) |
| ***H01F 27/30*** | (2006.01) |
| ***H01F 30/12*** | (2006.01) |

(52) U.S. Cl.

CPC ..... *H01F 27/29* (2013.01); *H01F 27/24* (2013.01); *H01F 27/30* (2013.01); *H01F 27/32* (2013.01); *H01F 30/12* (2013.01); *H01F 37/00* (2013.01)

(58) Field of Classification Search

USPC ..... 336/192, 170

See application file for complete search history.

(56) References Cited

U.S. PATENT DOCUMENTS

| | | | | |
|---|---|---|---|---|
| 2008/0197961 | A1* | 8/2008 | Patel | H01F 21/12 336/170 |
| 2012/0154363 | A1 | 6/2012 | Kim et al. | |
| 2013/0187741 | A1* | 7/2013 | Goodrich | H01F 3/10 336/170 |
| 2014/0091891 | A1* | 4/2014 | Metzler | H01F 27/29 336/192 |
| 2016/0125998 | A1 | 5/2016 | Bhide et al. | |
| 2017/0011842 | A1 | 1/2017 | Ishigaki et al. | |
| 2018/0090262 | A1 | 3/2018 | Tsukada et al. | |
| 2018/0122564 | A1 | 5/2018 | Tsukada et al. | |
| 2018/0254135 | A1 | 9/2018 | Tsukada et al. | |

FOREIGN PATENT DOCUMENTS

| | | | |
|---|---|---|---|
| CN | 201765902 | U | 3/2011 |
| DE | 102017121535 | A1 | 3/2018 |
| DE | 102017124933 | A1 | 5/2018 |
| DE | 102018104316 | A1 | 9/2018 |
| JP | 2009-283706 | A | 12/2009 |

(Continued)

*Primary Examiner* — Elvin G Enad
*Assistant Examiner* — Kazi S Hossain
(74) *Attorney, Agent, or Firm* — RatnerPrestia

(57) ABSTRACT

An AC reactor according to an embodiment of this disclosure includes a peripheral iron core, and at least three iron core coils contacting or connected to an inner surface of the peripheral iron core. Each of the iron core coils includes an iron core and a coil wound around the iron core. The AC reactor further includes a terminal base unit for covering the iron core coils.

6 Claims, 8 Drawing Sheets

(56) References Cited

FOREIGN PATENT DOCUMENTS

| | | | | |
|---|---|---|---|---|
| JP | 2010045111 | A | | 2/2010 |
| JP | 2010252539 | A | | 11/2010 |
| JP | 2011254005 | A | | 12/2011 |
| JP | 2012022940 | A | * | 2/2012 |
| KR | 101153580 | B1 | | 6/2012 |
| WO | 2010119324 | A2 | | 10/2010 |

* cited by examiner

AC REACTOR HAVING TERMINAL BASE

This application is a new U.S. patent application that claims benefit of JP 2017-053291 filed on Mar. 17, 2017, the content of 2017-053291 is incorporated herein by reference.

BACKGROUND OF THE INVENTION

1. Field of the Invention

The present invention relates to an AC reactor, and more specifically relates to an AC reactor having a terminal base.

2. Description of Related Art

Alternating current (AC) reactors are used in order to reduce harmonic current occurring in inverters, etc., to improve input power factors, and to reduce inrush current to the inverters. AC reactors have an iron core made of a magnetic material and a coil wound around the iron core.

Three-phase AC reactors having three-phase coils (windings) arranged in a line have been known (for example, refer to Japanese Unexamined Patent Publication (Kokai) No. 2009-283706, hereinafter referred to as Patent Document 1). Patent Document 1 discloses a reactor having three windings each of which is connected to a pair of terminals at both ends. The reactor is connected to another electric circuit through the terminals.

SUMMARY OF THE INVENTION

However, since conventional three-phase AC reactors have a problem that terminals for connecting coils to external equipment are exposed to the outside, insulation protection for the terminals is insufficient.

An AC reactor according to an embodiment of this disclosure includes a peripheral iron core, and at least three iron core coils contacting or connected to an inner surface of the peripheral iron core. Each of the iron core coils includes an iron core and a coil wound around the iron core. The AC reactor further includes a terminal base unit for covering the iron core coils.

BRIEF DESCRIPTION OF THE DRAWINGS

The objects, features and advantages of the present invention will become more apparent from the following description of embodiments along with the accompanying drawings. In the accompanying drawings.

DETAILED DESCRIPTION OF THE INVENTION

AC reactors according to embodiments of the present invention will be described below with reference to the drawings. However, the technical scope of the present invention is not limited to the embodiments, but embraces the invention described in claims and equivalents thereof.

Figure 1:
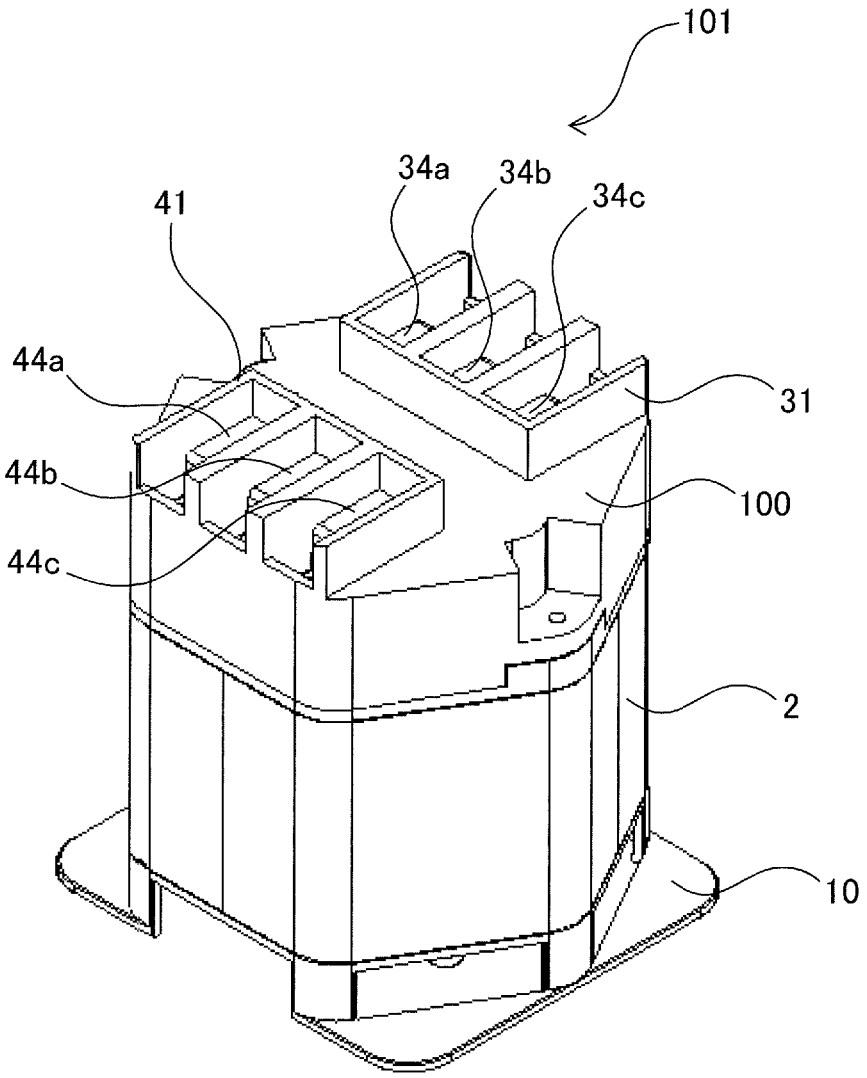
FIG. 1 is a perspective view of an AC reactor according to a first embodiment.
Figure 2:
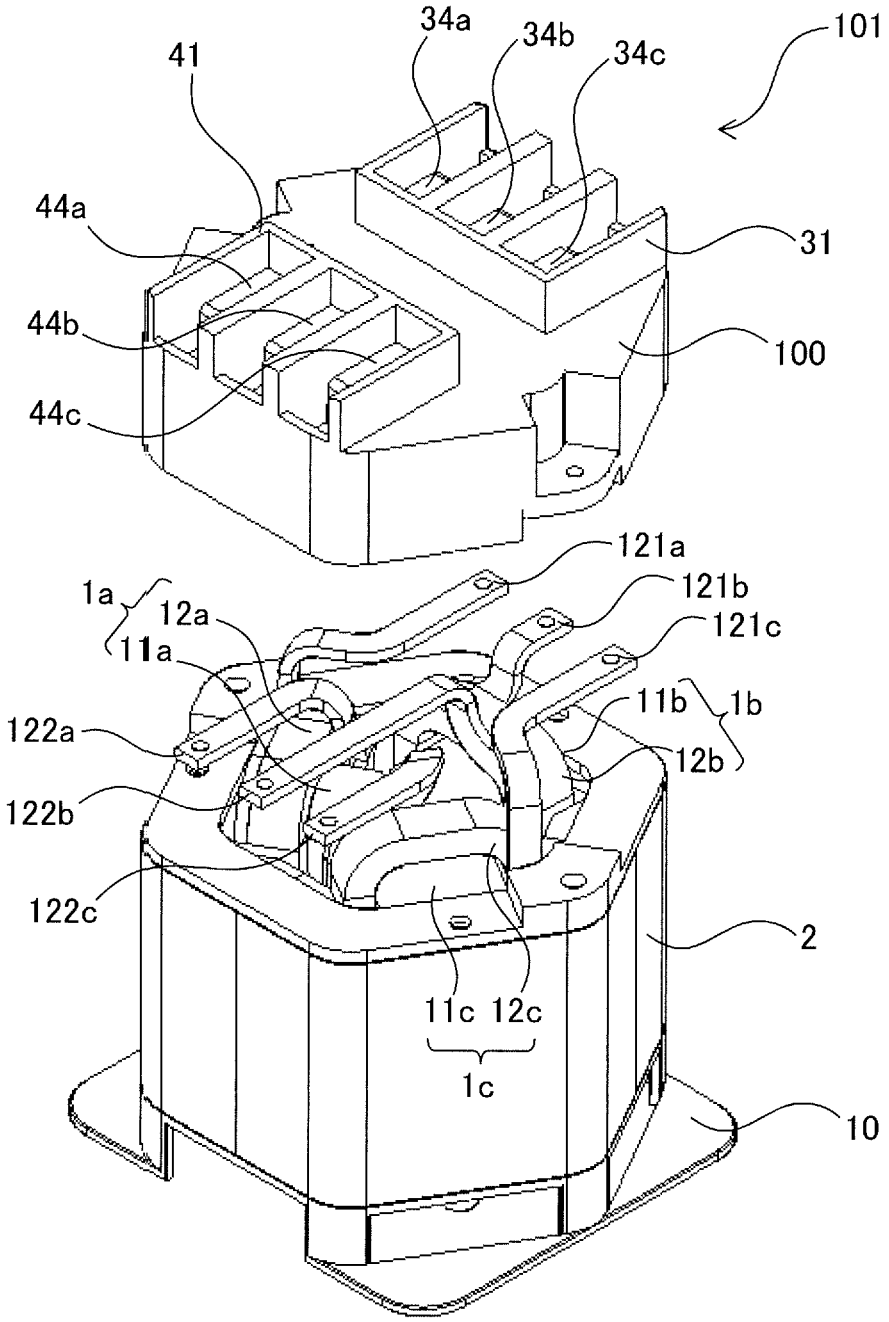
FIG. 2 is a perspective view of the AC reactor according to the first embodiment, before a terminal base unit has been provided.

An AC reactor according to a first embodiment will be described. FIG. 1 is a perspective view of the AC reactor according to the first embodiment. FIG. 2 is a perspective view of the AC reactor according to the first embodiment, before a terminal base unit has been provided. An AC reactor 101 according to the first embodiment has a peripheral iron core 2, at least three iron core coils (1*a*, 1*b*, and 1*c*), and a terminal base unit 100.

The peripheral iron core 2, which is integrated with iron cores (11*a*, 11*b*, and 11*c*), is disposed so as to enclose the iron core coils (1*a*, 1*b*, and 1*c*).

The iron core coils (1*a*, 1*b*, and 1*c*) are disposed so as to contact or be connected to an inner surface of the peripheral iron core 2. Each of the iron core coils (1*a*, 1*b*, and 1*c*) includes an iron core (11*a*, 11*b*, or 11*c*) and a coil (12*a*, 12*b*, or 12*c*) wound around the iron core.

The terminal base unit 100 is a disposed so as to cover the iron core coils (1*a*, 1*b*, and 1*c*). FIG. 2 is a perspective view of the AC reactor according to the first embodiment, before the terminal base unit 100 has been connected to coil terminals.

The iron core coils (1*a*, 1*b*, and 1*c*) include the iron cores (11*a*, 11*b*, and 11*c*) and the coils (12*a*, 12*b*, and 12*c*), respectively. Each of the coils (12*a*, 12*b*, and 12*c*) is wound around the iron core, and has an input terminal (121*a*, 121*b*, or 121*c*) and an output terminal (122*a*, 122*b*, or 122*c*). For example, the coils 12*a*, 12*b* and 12*c* may be an R-phase coil, an S-phase coil and a T-phase coil, respectively. However, the present invention is not limited to this example. Each of the input terminals (121*a*, 121*b*, and 121*c*) and the output terminals (122*a*, 122*b*, and 122*c*) preferably has a hole, at its distal end portion, to be connected to a connection portion of the terminal base, as described later.

FIG. 2 shows an example in which the iron core coils (1*a*, 1*b*, and 1*c*) are not arranged in a line. When terminals of the coils (12*a*, 12*b*, and 12*c*) are extended without routine in the longitudinal direction of the AC reactor 101, the terminals are not aligned, thus bringing about difficulty in connection to the terminal base. Thus, the input terminals (121*a*, 121*b*, and 121*c*) preferably extend vertically relative to the longitudinal direction of the AC reactor 101, such that the distal end portions of the input terminals (121*a*, 121*b*, and 121*c*) are arranged in a line. The output terminals (122*a*, 122*b*, and 122*c*) preferably extend vertically relative to the longitudinal direction of the AC reactor 101 and oppositely relative to the input terminals (121*a*, 121*b*, and 121*c*), such that the distal end portions of the output terminals (122*a*, 122*b*, and 122*c*) are arranged in a line. As shown in FIG. 2, when the longitudinal direction of the AC reactor 101 is vertical with respect to the ground, the input terminals (121*a*, 121*b*, and 121*c*) and the output terminals (122*a*, 122*b*, and 122*c*) preferably extend horizontally relative to the ground. Therefore, since the input terminals (121*a*, 121*b*, and 121*c*) and the output terminals (122*a*, 122*b*, and 122*c*) extend vertically relative to the longitudinal direction of the AC reactor, the AC reactors can be short in height in the longitudinal direction and be small in size, when compared with the case of extending the terminals in the longitudinal direction of the AC reactor.

Furthermore, the distal end portions of the input terminals (121*a*, 121*b*, and 121*c*) and the distal end portions of the output terminals (122*a*, 122*b*, and 122*c*) are arranged in a line, and therefore facilitate connecting the input terminals (121*a*, 121*b*, and 121*c*) and the output terminals (122*a*, 122*b*, and 122*c*) to the terminal base.

Figure 3:
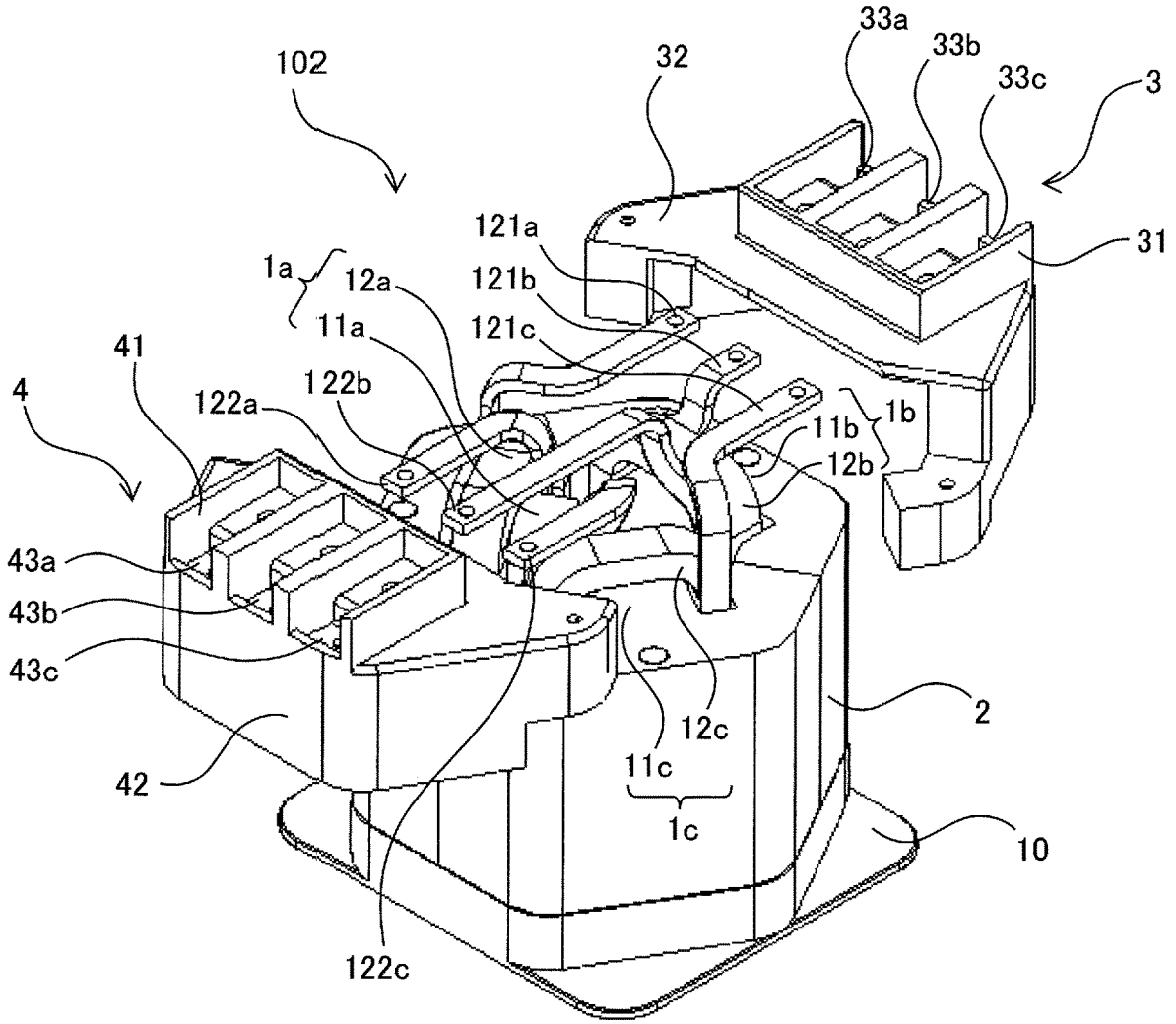
FIG. 3 is a perspective view of an AC reactor according to a second embodiment, before a first terminal base unit and a second terminal base unit have been connected to coil terminals.

Next, an AC reactor according to a second embodiment will be described. FIG. 3 is a perspective view of the AC reactor according to the second embodiment, before a first terminal base unit and a second terminal base unit have been connected to coil terminals. The difference between an AC reactor 102 accordion to the second embodiment and the AC reactor 101 according to the first embodiment is that a terminal base unit includes a first terminal base unit 3 having first connection portions to be connected to input terminals of coils and a second terminal base unit 4 having second connection portions to be connected to output terminals of the coils, and the first terminal base unit 3 and the second terminal base unit 4 cover iron core coils in a joined state. The other structures of the AC reactor 102 according to the second embodiment are the same as that of the AC reactor 101 according to the first embodiment, so a detailed description thereof is omitted.

The first terminal base unit 3 includes a first terminal base 31 and a first cover portion 32. The first terminal base 31 and the first cover portion 32 are preferably integrated into one unit. The second terminal base unit 4 includes a second terminal base 41 and a second cover portion 42. The second terminal base 41 and the second cover portion 42 are preferably integrated into one unit. The first terminal base unit 3 and the second terminal base unit 4 are preferably made of an insulating material such as plastic. However, first connection portions (33*a*, 33*b*, and 33*c*) provided in the first terminal base 31 and second connection portions (43*a*, 43*b*, and 43*c*) provided in the second terminal base 41 are preferably made of electrical conductors such as metal.

The first terminal base unit 3 has the first connection portions (33*a*, 33*b*, and 33*c*) to be connected to input terminals (121*a*, 121*b*, and 121*c*), respectively. The second terminal base unit 4 has the second connection portions (43*a*, 43*b*, and 43*c*) to be connected to output terminals (122*a*, 122*b*, and 122*c*), respectively. The first connection portions (33*a*, 33*b*, and 33*c*) are preferably made of electric conductors to establish connection to the input terminals (121*a*, 121*b*, and 121*c*), respectively. In the same manner, the second connection portions (43*a*, 43*b*, and 43*c*) are preferably made of electric conductors to establish connection to the output terminals (122*a*, 122*b*, and 122*c*), respectively.

The first connection portions (33*a*, 33*b*, and 33*c*) have holes. The holes are aligned with holes provided in the input terminals (121*a*, 121*b*, and 121*c*), and thereafter secured with screws or the like. In the same manner, the second connection portions (43*a*, 43*b*, and 43*c*) have holes. The holes are aligned with holes provided in the output terminals (122*a*, 122*b*, and 122*c*), and thereafter secured with screws or the like.

Figure 4:
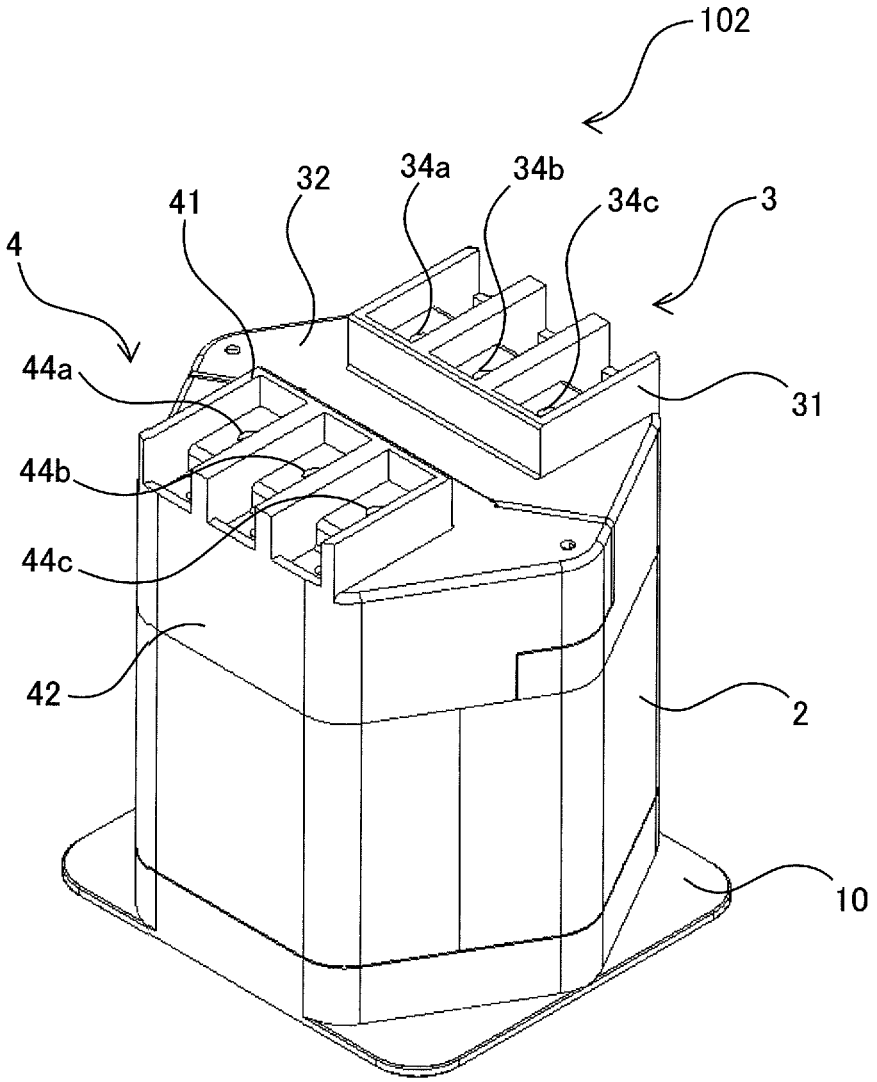
FIG. 4 is a perspective view of the AC reactor according to the second embodiment, after the first terminal base unit and the second terminal base unit have been connected to the coil terminals.

FIG. 4 is a perspective view of the AC reactor according to the second embodiment, after the first terminal base unit and the second terminal base unit have been connected to the coil terminals. The first terminal base unit 3 and the second terminal base unit 4 are preferably joined together without any gaps therebetween, in the state of being connected to the input terminals (121*a*, 121*b*, and 121*c*) and the output terminals (122*a*, 122*b*, and 122*c*), respectively. According to this structure, the first terminal base unit 3 and the second terminal base unit 4 prevent the coils (12*a*, 12*b*, and 12*c*) from being exposed to the outside, and therefore provide insulation protection of the coils (12*a*, 12*b*, and 12*c*). This structure facilitates connecting external equipment to the AC reactor, as compared to the case of directly connecting the external equipment to the input terminals (121*a*, 121*b*, and 121*c*) and the output terminals (122*a*, 122*b*, and 122*c*).

Furthermore, when the first terminal base unit 3 and second terminal base unit 4 are joined together, the outside shape thereof is preferably the same as that of a peripheral iron core 2, and the first terminal base unit 3 and the second terminal base unit 4 are preferably mounted on the peripheral iron core 2 without any gaps. According to this structure, the first terminal base unit 3 and the second terminal base unit 4 can be stably disposed on the peripheral iron core 2. This structure prevents disconnection between the connection portions of the terminal base and the input and output terminals of the coils, even if the AC reactor vibrates or the like.

The first terminal base unit 3 and second terminal base unit 4 that have been once joined may be separated again. This structure facilitates disassembly of the AC reactor and replacement of the terminal base, as compared with the case of using a general terminal base.

The first terminal base unit 3 has first terminals (34*a*, 34*b*, and 34*c*) to establish connection to external equipment. The second terminal base unit 4 has second terminals (44*a*, 44*b*, and 44*c*) to establish connection to external equipment. The first terminals (34*a*, 34*b*, and 34*c*) are electrically connected to the first connection portions (33*a*, 33*b*, and 33*c*), respectively. The second terminals (44*a*, 44*b*, and 44*c*) are electrically connected to the second connection portions (43*a*, 43*b*, and 43*c*), respectively. As a result, the external equipment can be electrically connected to the coils (12*a*, 12*b*, and 12*c*) through the first terminals (34*a*, 34*b*, and 34*c*) and the second terminals (44*a*, 44*b*, and 44*c*).

The first terminals 34*a*, 34*b*, and 34*c*) and the second terminals (44*a*, 44*b*, and 44*c*) are preferably arranged in a line. This structure facilitates connection of the AC reactor 102 to the external equipment.

Figure 5:
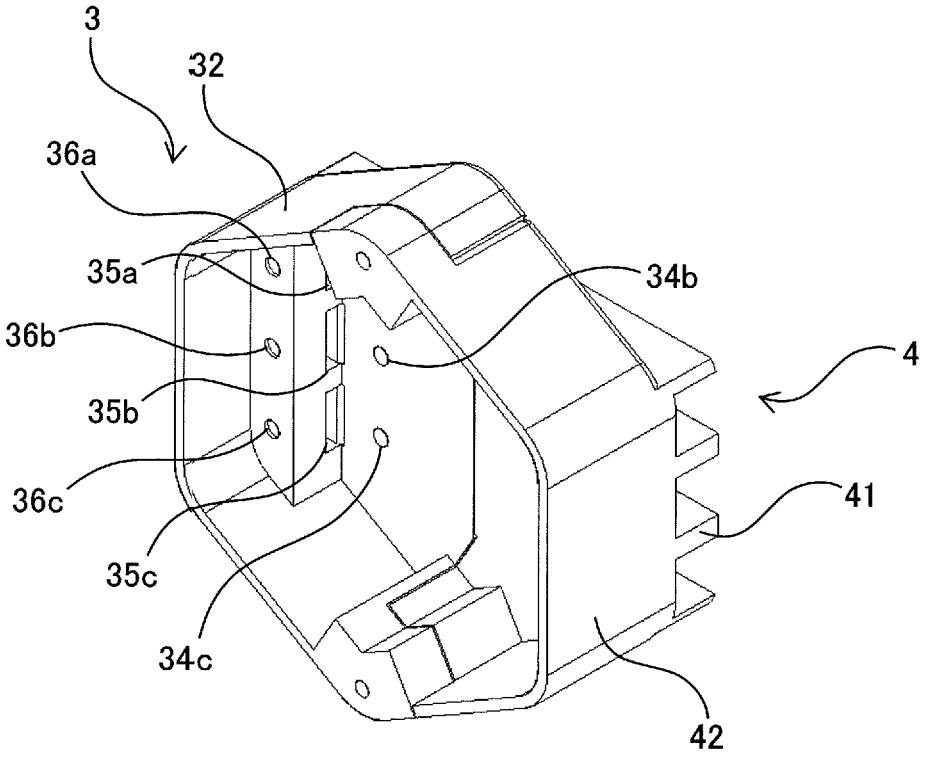
FIG. 5 is a perspective view of the first terminal base unit and the second terminal base unit on a rear side, which constitute the AC reactor according to the second embodiment.

FIG. 5 is a perspective view of the first terminal base unit and the second terminal base unit on a rear side, which constitute the AC reactor according to the second embodiment. The first terminal base unit 3 is provided with openings (35*a*, 35*b*, and 35*c*). By passing the input terminals (121*a*, 121*b*, and 121*c*) (refer to FIG. 3) of the coils (12*a*, 12*b*, and 12*c*) through the openings (35*a*, 35*b*, and 35*c*) from the inside to the outside of the first terminal base unit 3, the input terminals (121*a*, 121*b*, and 121*c*) are electrically connected to the first connection portions (33*a*, 33*b*, and 33*c*), respectively.

As shown in FIG. 3, the input terminals (121*a*, 121*b*, and 121*c*) extend vertically relative to the longitudinal direction of the reactor. Thus, the AC reactor has the advantage that a process of passing the input terminals through the openings (35*a*, 35*b*, and 35*c*) of the first terminal base unit 3 along the direction of extension of the input terminals (121*a*, 121*b*, and 121*c*) can be easily automated.

The first terminal base unit 3, at the rear of the first connection portions (33*a*, 33*b*, and 33*c*), is provided with through holes (36*a*, 36*b*, and 36*c*). The through holes (36*a*, 36*b*, and 36*c*) are preferably situated in the same positions as through holes (not illustrated) provided in the first connection portions (33*a*, 33*b*, and 33*c*). Thus, when securing the holes of the first connection portions (33*a*, 33*b*, and 33*c*) and the holes of the input terminals (121*a*, 121*b*, and 121*c*) with screws or the like, the screws can penetrate through the through holes (36*a*, 36*b*, and 36*c*) as well. Therefore, the first connection portions and the input terminals can be secured to the first terminal base unit 3.

To connect the output terminals (122*a*, 122*b*, 122*c*) to the second connection portions (43*a*, 43*b*, and 43*c*), the second terminal base unit 4 is provided with openings (not illustrated), which are similar to the openings (35*a*, 35*b*, and 35*c*) of the first terminal base unit 3. The second terminal base unit 4, at the rear of the second connection portions (43*a*, 43*b*, and 43*c*), is provided with through holes (not illustrated), which are similar to the through holes (36*a*, 36*b*, and 36*c*) of the first terminal base unit 3, in the same positions as the through holes provided in the second connection portion (43*a*, 43*b*, and 43*c*).

As shown in FIG. 3, the output terminals (122*a*, 122*b*, and 122*c*) extend vertically relative to the longitudinal direction of the reactor. Thus, the AC reactor has the advantage that a process of passing the output terminals through the openings of the second terminal base unit 4 along the direction of extension of the output terminals (122*a*, 122*b*, and 122*c*) can be easily automated.

Figure 6A:
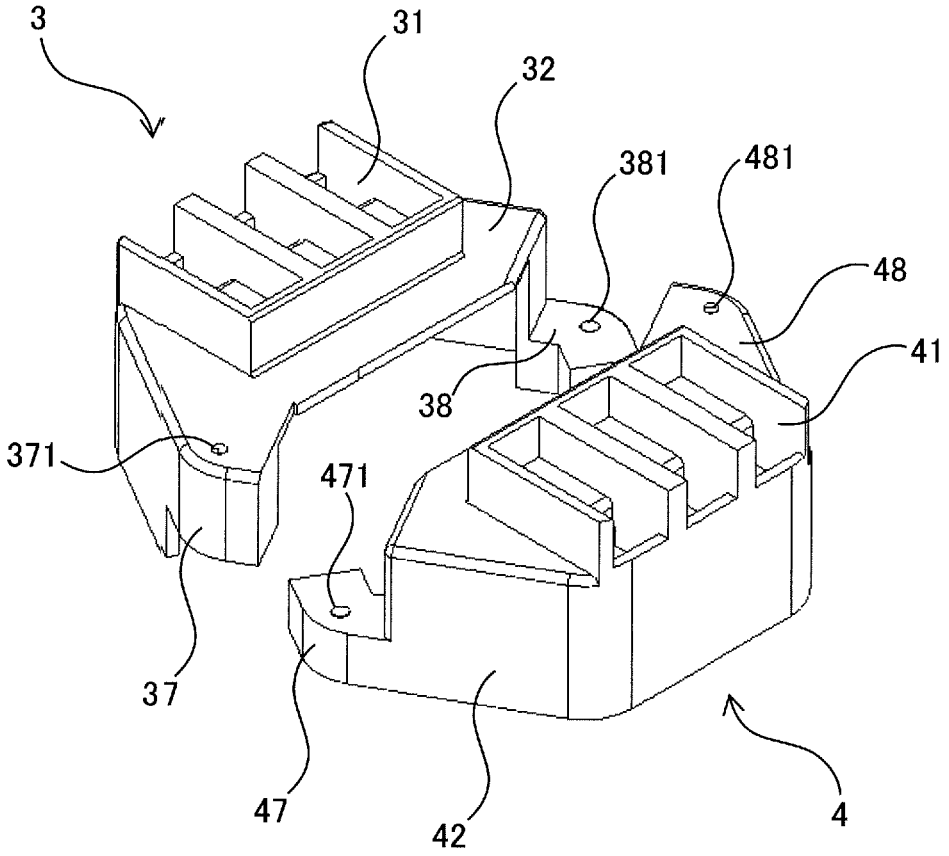
FIG. 6A is a perspective view showing the state before the first terminal base unit and the second terminal base unit have been joined constituting the AC reactor according to the second embodiment.
Figure 6B:
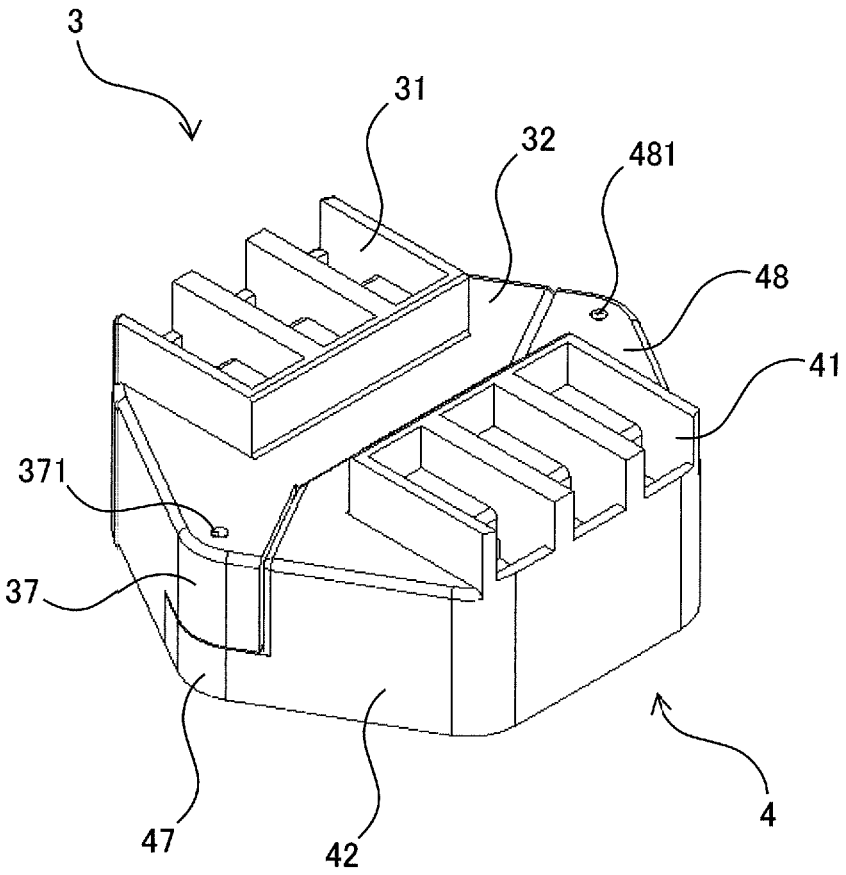
FIG. 6B is a perspective view showing the state after the first terminal base unit and the second terminal base unit have been joined constituting the AC reactor according to the second embodiment.

FIG. 6A shows the state before the first terminal base unit and the second terminal base unit constituting the AC reactor have been joined according to the second embodiment. FIG. 6B shows the state after the first terminal base unit and the second terminal base unit constituting the AC reactor have been joined according to the second embodiment. The first terminal base unit 3 includes first joint portions (37 and 38), and the second terminal base unit 4 includes second joint portions (47 and 48) be joined to the first joint portions (37 and 38).

For example, the first joint portions (37 and 38) include a first upper joint portion 37 and a first lower joint portion 38. The second joint portions (47 and 48) include a second upper joint portion 48 and a second lower joint portion 47.

The first upper joint portion 37 is joined to the second lower joint portion 47. When the first upper joint portion 37 and the second lower joint portion 47 are joined together, a through hole 371 provided in the first upper joint portion 37 and a through hole 471 provided in the second lower joint portion 47 are preferably disposed in the same position in the horizontal plane, so as to form one continuous through hole. The first upper joint portion 37 and the second lower joint portion 47 can be secured with the one continuous through hole. For example, both of the joint portions can be secured by screwing a screw or inserting a through rod into the through holes 371 and 471.

The first lower joint portion 38 is joined to the second upper joint portion 48. When the first lower joint portion 38 and the second upper joint portion 48 are joined together, a through hole 381 provided in the first lower joint portion 38 and a through hole 481 provided in the second upper joint portion 48 are preferably disposed in the same position in the horizontal plane, so as to form one continuous through hole. The first lower joint portion 38 and the second upper joint portion 48 can be secured with the one continuous through hole. For example, both of the joint portions can be secured by screwing a screw or inserting a through rod into the through holes 381 and 481.

The first terminal base unit 3 and the second terminal base unit 4 preferably have the same structure. This structure allows shared use of one type of terminal base unit as the first terminal base unit 3 and the second terminal base unit 4, thus improving efficiency in an assembly operation and reducing manufacturing cost for the terminal base units.

Figure 7:
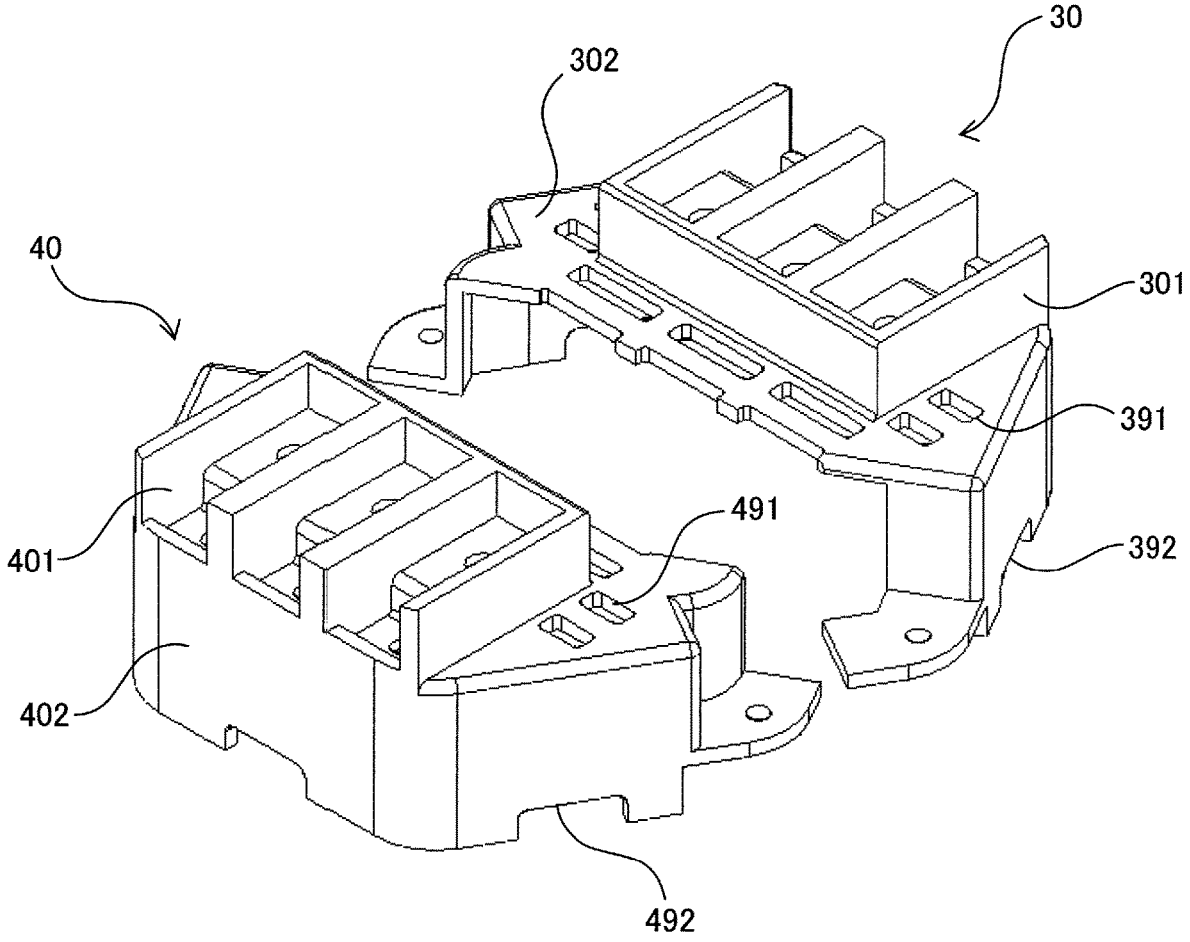
FIG. 7 is a perspective view of a first terminal base unit and a second terminal base unit constituting an AC reactor according to a third embodiment.

Next, an AC reactor according to a third embodiment of this disclosure will be described. FIG. 7 is a perspective view of a first terminal base unit and a second terminal base unit constituting the AC reactor according to the third embodiment. The difference between the AC reactor according to the third embodiment and the AC reactor according to the second embodiment is that at least one of a first terminal base unit 30 and a second terminal base unit 40 has slits. The other structures of the AC reactor according to the third embodiment are the same as that of the AC reactor according to the second embodiment, so a detailed description thereof is omitted.

In the first terminal base unit 30, first top slits 391 are formed in a top surface of a first cover portion 302 in the vicinity of a first terminal base 301. Furthermore, first bottom slits 392 are formed at the bottom of the first cover portion 302 of the first terminal base unit 30.

In the second terminal base unit 40, second top slits 491 are formed in a top surface of a second cover portion 402 in the vicinity of a second terminal base 401. Furthermore, second bottom slits 492 are formed at the bottom of the second cover portion 402 of the second terminal base unit 40.

When the first terminal base unit 30 and the second terminal base unit 40 are joined together and mounted on the peripheral iron core 2, outside air is drawn through the first bottom slits 392 and the second bottom slits 492, and ejected through the first top slits 391 and the second top slits 491. This allows heat generated from coils (12*a*, 12*b*, and 12*c*) to escape to the outside.

In the example of FIG. 7, the rectangular slits are formed in the first terminal base unit 30 and the second terminal base unit 40, but not limited to this example, the slits may have other shapes such as round. Furthermore, the slits are formed in the top surfaces and at the bottoms of the first terminal base unit 30 and the second terminal base unit 40, but not limited to this example, slits may be formed in side surfaces.

The AC reactor according to the third embodiment increases the efficiency of the dissipation of heat generated from the coils, while providing insulation protection of the coils by the first terminal base unit 30 and the second terminal base unit 40.

In the above description, the terminals (121*a*, 121*b*, and 121*c*) are designated as the input terminals, and the terminals (122*a*, 122*b*, and 122*c*) are designated as the output terminals, but the present invention is not limited to this example. In other words, the terminals (121*a*, 121*b*, and 121*c*) may be designated as output terminals, and the terminals (122*a*, 122*b*, and 122*c*) may be designated as input terminals.

The AC reactor according to the embodiments of this disclosure easily provides insulation protection for the terminals to connect the coils to the external equipment.

What is claimed is:

1. An AC reactor comprising:

a peripheral iron core;

at least three iron core coils extending radially outwardly from a center of the peripheral iron core and contacting or connected to an inner surface of the peripheral iron core, each of the iron core coils including:

an iron core and a coil wound around the iron core, an input terminal, and an output terminal, wherein a distal end of the input terminal of each of the iron cores is arranged along a first line, and wherein a distal end of the output terminal of each of the iron cores is arranged along a second line; and a terminal base unit for covering the iron core coils, the terminal base unit including:

an input terminal connection portion including a respective input electrical connector for each input terminal, each respective input electrical connector is arranged along the first line, and an output terminal connection portion including a respective output electrical connector for each output terminal, each respective output electrical connector is arranged along the second line, wherein each input terminal is connected to the respective input electrical connector through a respective input opening in the terminal base unit, and each output terminal is connected to the respective output electrical connector through a respective output opening in the terminal base unit.

2. The AC reactor according to claim 1, further comprising input terminals and output terminals extending vertically relative to a longitudinal direction of the AC reactor, the input terminals and the output terminals having distal end portions arranged in a line.

3. The AC reactor according to claim 1, wherein the terminal base unit includes:

a first terminal base unit having a first connection portion connected to the input terminal of the coil; and a second terminal base unit having a second connection portion connected to the output terminal of the coil, wherein the first terminal base unit and the second terminal base unit cover the iron core coils in a joined state.

4. The AC reactor according to claim 3, wherein the first terminal base unit has a first joint portion; and the second terminal base unit has a second joint portion to be joined to the first joint portion.

5. The AC reactor according to claim 3, wherein the first terminal base unit and the second terminal base unit have the same structure.

6. The AC reactor according to claim 3, wherein at least one of the first terminal base unit and the second terminal base unit has a slit.

* * * * *